US007320613B1

(12) United States Patent
Ratzlaff

(10) Patent No.: US 7,320,613 B1
(45) Date of Patent: Jan. 22, 2008

(54) AUTOMATIC LOCKING ELECTRICAL OUTLET

(75) Inventor: Jason Daniel Ratzlaff, Templeton, CA (US)

(73) Assignee: Inventor's Group, LLC, Paso Robles, CA (US)

( * ) Notice: Subject to any disclaimer, the term of this patent is extended or adjusted under 35 U.S.C. 154(b) by 0 days.

(21) Appl. No.: 11/729,528

(22) Filed: Mar. 28, 2007

(51) Int. Cl.
*H01R 13/625* (2006.01)

(52) U.S. Cl. ..... 439/345; 439/346

(58) Field of Classification Search ..... 439/345, 439/346, 106, 347–348
See application file for complete search history.

(56) References Cited

U.S. PATENT DOCUMENTS 3,710,304 A 1/1973 Warner et al.
4,136,919 A 1/1979 Howard et al.
4,586,770 A 5/1986 Poulin
4,784,611 A 11/1988 Poulin et al.
5,352,132 A * 10/1994 O'Keefe et al. ..... 439/346
5,413,498 A 5/1995 Ursich
5,893,772 A * 4/1999 Carmo et al. ..... 439/346
6,004,163 A * 12/1999 Behling et al. ..... 439/701
6,193,539 B1 * 2/2001 Chang ..... 439/346
2003/0207606 A1 11/2003 Ho

* cited by examiner

*Primary Examiner*—Jean F. Duverne
(74) *Attorney, Agent, or Firm*—Nixon Peabody LLP

(57) ABSTRACT

A female locking electrical outlet is provided including an outlet body having slots for apertured prongs of a standard male electrical plug, a pair of receptacles and a locking member mounted within the outlet body. The locking member has locking tabs that engage within apertures in the prongs when the outlet is in a locked position and the electrical plug is connected to the outlet. The outlet has a release mechanism with a release member for engaging the locking member and to transition the locking member from the locked position to an unlocked position. The outlet is capable of being mounted on the end of an extension cord or within a standard wall outlet box, and for use in portable generators, UPS systems, and other auxiliary power sources containing female receptacles.

18 Claims, 17 Drawing Sheets

AUTOMATIC LOCKING ELECTRICAL OUTLET

CROSS REFERENCE TO RELATED APPLICATION

This application relates to an improvement of the automatic locking electrical outlet disclosed and claimed in U.S. Pat. No. 7,172,451, issued on Feb. 6, 2007, which is incorporated by reference herein. The outlet disclosed and claimed in the '451 patent is more complex and difficult to manufacture than the outlet of the present invention in which the number of moving parts and the use of more costly high tensile, high elasticity metals have been eliminated.

FIELD OF THE INVENTION

The invention is directed to an electrical receptacle or other outlet that houses a wiring system for electrical current to run standard male plug-in electrical devices. More particularly, the invention is directed to automatic locking outlets including female plugs or sockets for mounting to extension cords, female receptacles that automatically are locked to prevent disconnection when connected to standard male plugs.

BACKGROUND OF THE INVENTION

Female locking outlets for extension cords are well known in the art; see, e.g., U.S. Pat. Nos. 3,710,304; 4,136.919; 5,352,132; and 5,413,498. In these prior art references, a female locking outlet incorporates a pair of release buttons, unlocking pins, or locking balls that fit into the apertures of a standard male plug. However, none of these prior art locking receptacles automatically lock when the male plug is connected to the receptacle.

There is a need for a female locking electrical outlet that automatically locks when the male plug is connected to an extension cord outlet or wall receptacle. There is also a need for a less complex and easier to manufacture female locking electrical outlet than those of the prior art.

SUMMARY OF THE INVENTION

One embodiment of an automatic female locking electrical outlet of the present invention includes an outlet body having at least one pair of slots for apertured prongs of a male electrical plug, a pair of receptacles for each of the at least one pair of slots respectively mounted within the outlet body, a locking member having inner ends inwardly angled toward a longitudinal axis of the outlet and locking tabs that are positional within apertures in the prongs to place the outlet in a locked position when an electrical plug is connected to the outlet, and at least one unlocking or release mechanism having a release member for engaging the locking member and to transition the locking member from the locked position to an unlocked position.

The automatic female locking electrical outlets or receptacles of the present invention include female plugs or sockets for mounting to extension cords, receptacles for wall mounting and for use in portable generators, UPS (uninterrupted powers supply) systems, and other auxiliary power sources containing female receptacles that automatically are locked to prevent disconnection when connected to standard male plugs.

In the embodiment of an automatic female locking electrical outlet of the present invention suitable for use as a locking wall receptacle, the outlet includes an outlet body having two pair of slots within the body for the apertured prongs, a pair of receptacles for each of the two pairs of slots, a locking member with locking tabs that are positional within the prong apertures to automatically place the outlet in a locked position when an electrical plug is connected to the outlet, and a release mechanisms having a release members for engaging the locking member and to transition the locking member from the locked position to an unlocked position. The outlet body is designed to fit into the opening of a standard outlet box and to be attached to a standard outlet box for mounting to a wall.

BRIEF DESCRIPTION OF THE DRAWINGS

Further features and advantages will become apparent from the following and more particular description of various embodiments of the present invention, as illustrated in the accompanying drawings in which.

DETAILED DESCRIPTION OF VARIOUS EMBODIMENTS OF THE PRESENT INVENTION

Figure 1:
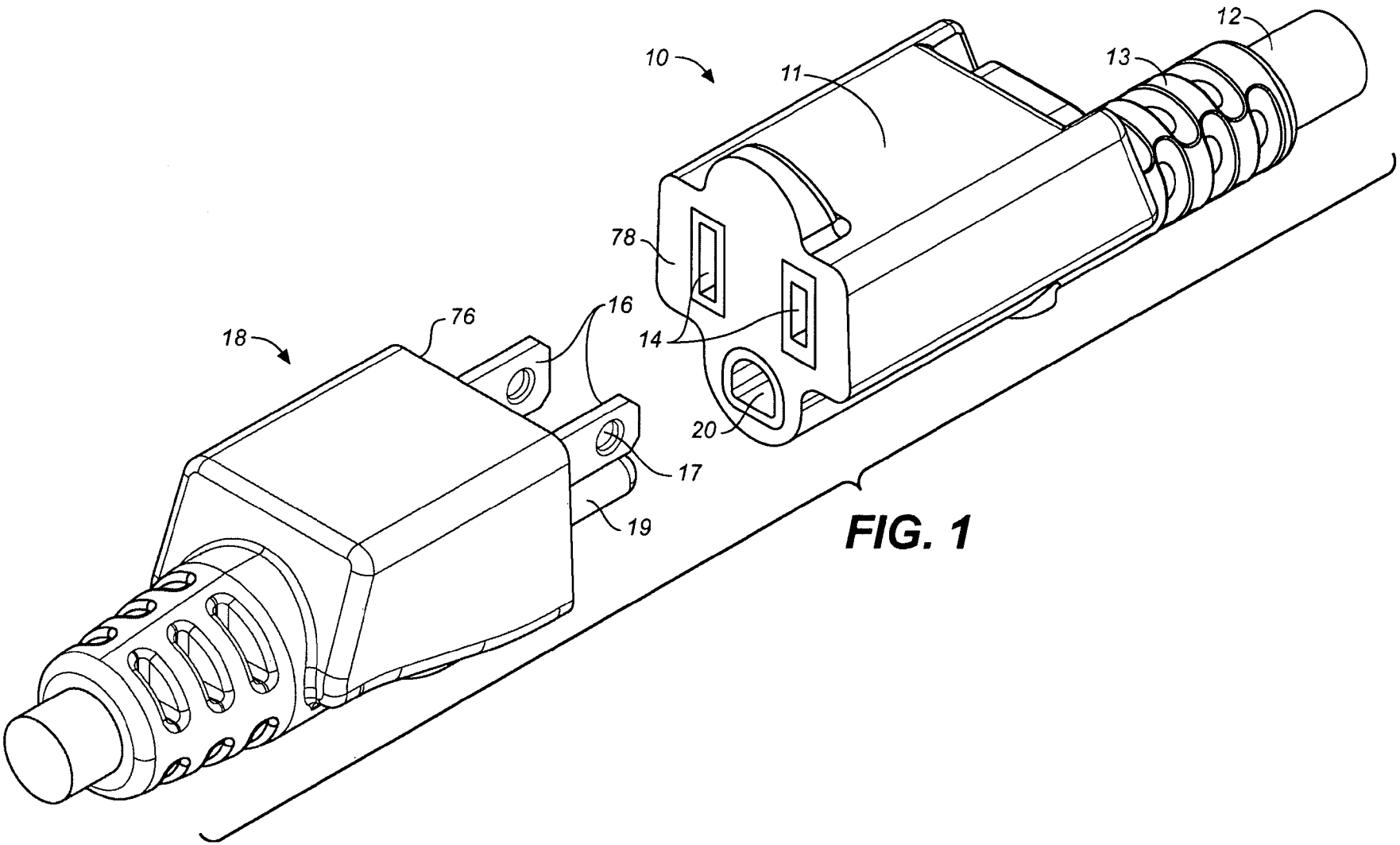
FIG. 1 is an upper right frontal perspective view of a female locking electrical outlet of one embodiment of the present invention and a standard grounded male electrical plug.

FIGS. 1-9 show various views of one embodiment of the locking electrical outlet present invention. Specifically, FIG. 1 shows an electrical outlet 10 having over-mold 11 capable of being mounted at the end of a standard extension cord 12 having a strain relief section 13. Outlet 10 has a pair of slots 14 for accepting negative and positive prongs 16 with apertures 17 of a standard male electrical plug 18 and a ground slot 20 for accepting a ground 19 of plug 18. Strain relief section 13 is used in cord manufacture to prevent the pulling load on cord 12 of varying gauges and lengths from being transmitted to the receptacle 10. FIG. 1 represents only one of numerous uses of locking outlet 10. It is apparent that outlet 10 can be made as a replacement outlet for use on all types of existing electrical cords.

Figure 2:
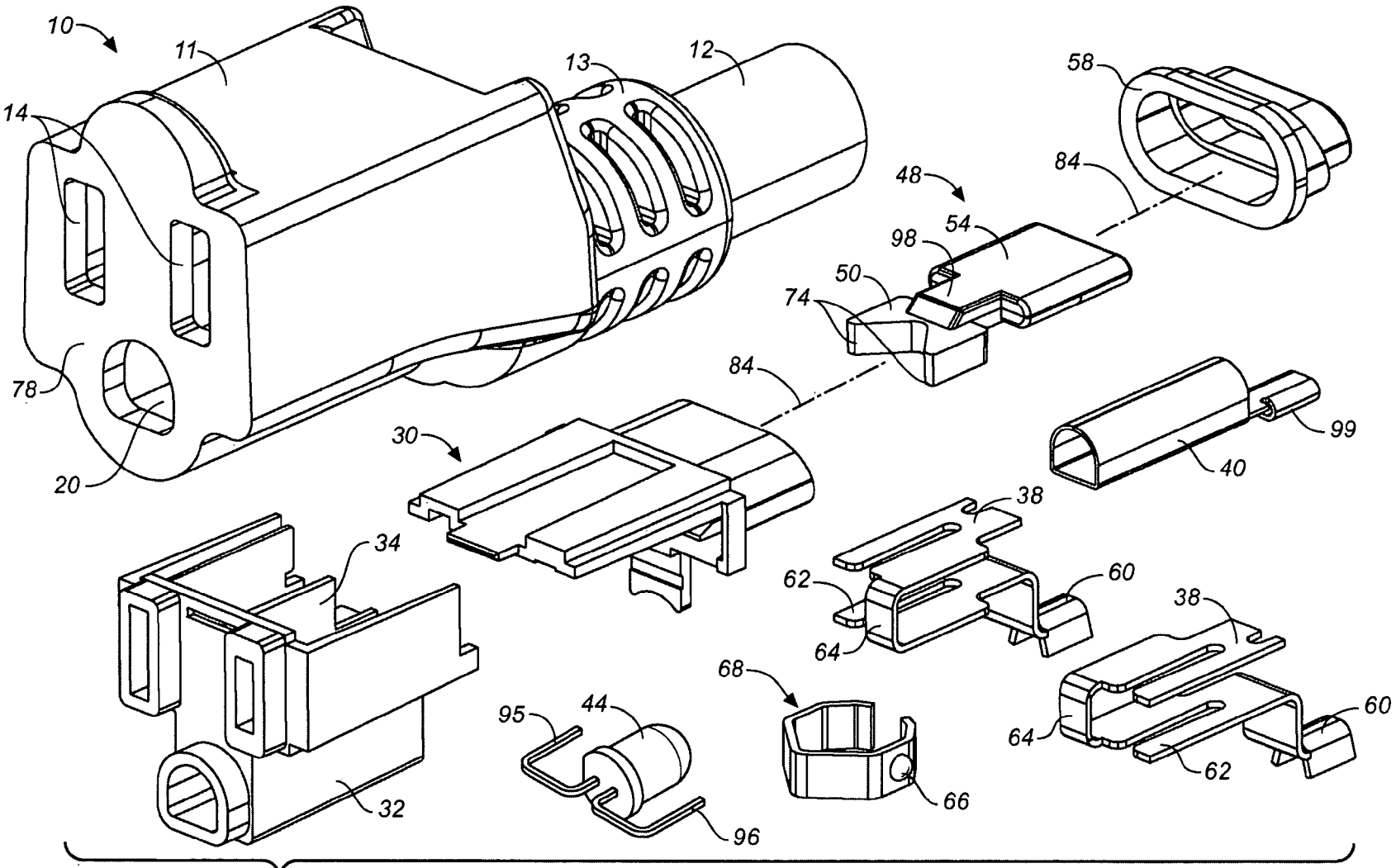
FIG. 2 is an exploded upper right frontal perspective view of the female locking electrical outlet of the embodiment of FIG. 1.
Figure 3:
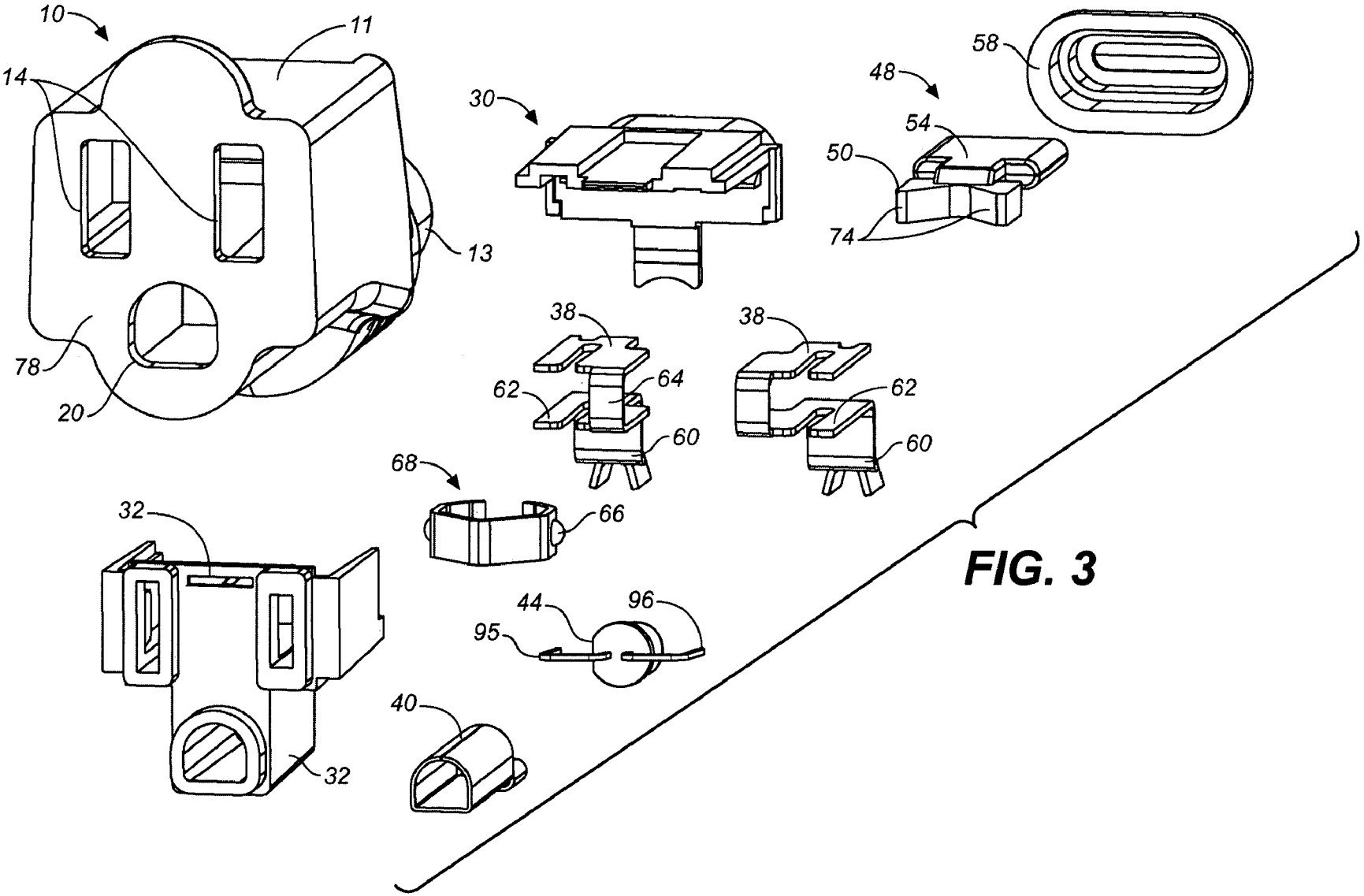
FIG. 3 is an exploded upper right frontal perspective view of the outlet of the embodiment of FIG. 1 from a more frontal standpoint from than that shown in FIG. 2.

FIGS. 2 and 3 show various exploded views of the internals of female locking electrical outlet 10. The internals of outlet 10 that are mounted within over-mold 11 include receptacle housing cover 30, receptacle housing body 32, an insulator 34, a pair of receptacles 38, a locking member 68, standard ground receptacle 40, LED (light emitting diode) 44, release mechanism 48 having release member 50 at the inner end of release button 54, and a cover 58. Cover 58 is preferably made of a rubber weather resistant material. Although LED 44 is preferably included with the embodiment of the outlet 10 shown in FIGS. 23, use of an LED is not essential. Cover 58 fits over the outer end 59 of release button 54 and protrudes from over-mold 11 to protect the user from electrical shock. Insulator 34 is a non-conducting material such as a thermoplastic and is attached to housing body 32 between the pair of receptacles 38 as shown in FIGS. 2, 5, 5A and 5B.

Figure 4:
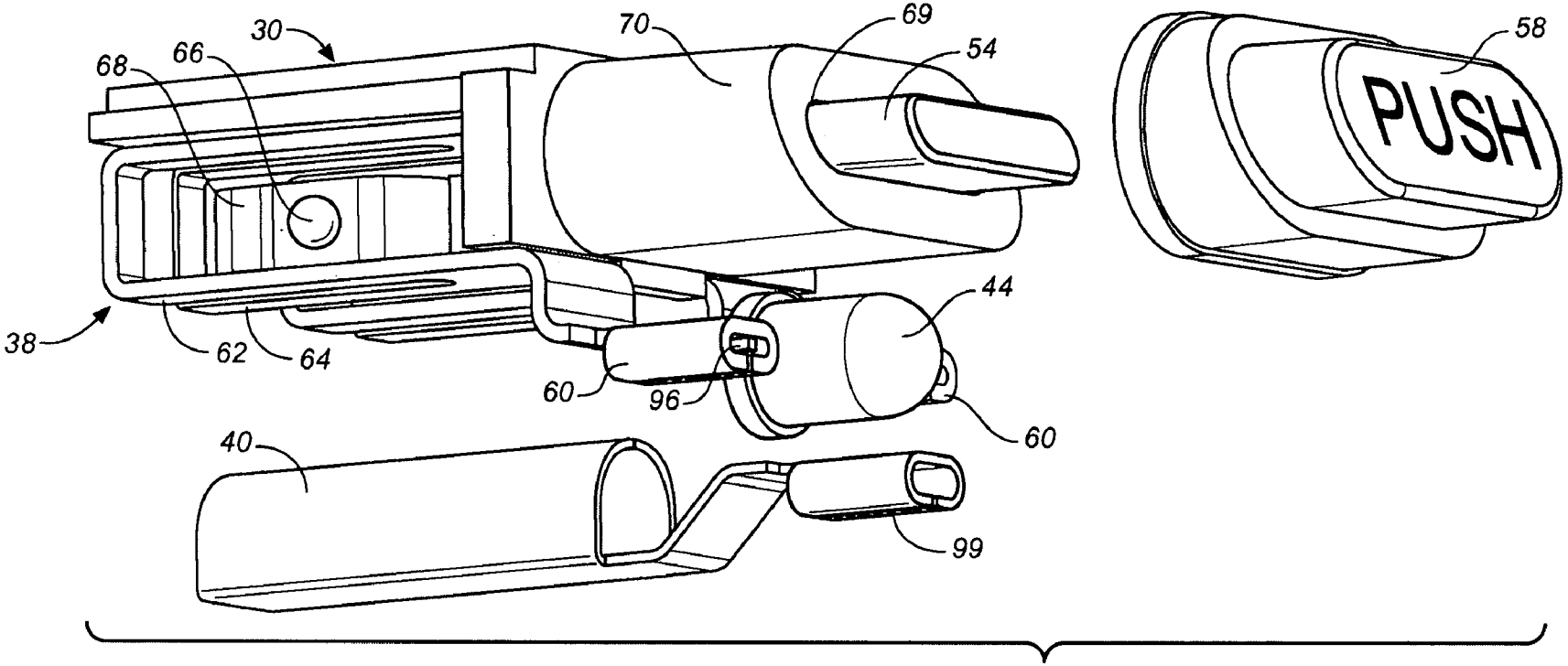
FIG. 4 is an lower right rear perspective view of the assembled internals of the outlet of the embodiment of FIG. 1 with an unassembled release button cover.
Figure 5:
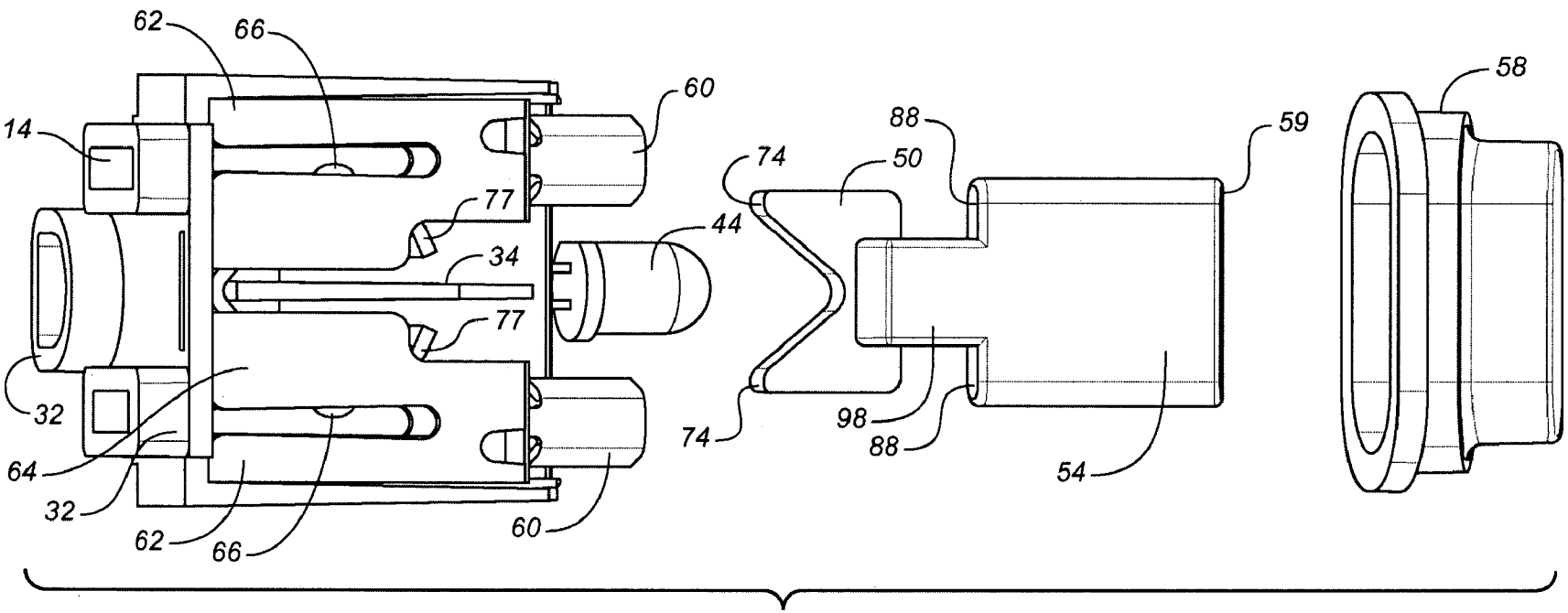
FIG. 5 is an exploded top perspective view of the assembled internals of the outlet of the embodiment of FIG. 1 with the unassembled release button cover as shown in FIG. 4.

FIGS. 4 and 5 show the respective rear and top views of the assembled internals of the female locking electrical outlet 10. The pair of receptacles 38 has flanges 60 for receiving the respective positive and negative lead lines (see FIGS. 6B, 7B and 9), outer arm 62 and inner arm 64. Outer arm 62 and inner arm 64 are U-shaped to form the receptacle for making electrical contact with prongs 16 of plug 18.

Figure 5A:
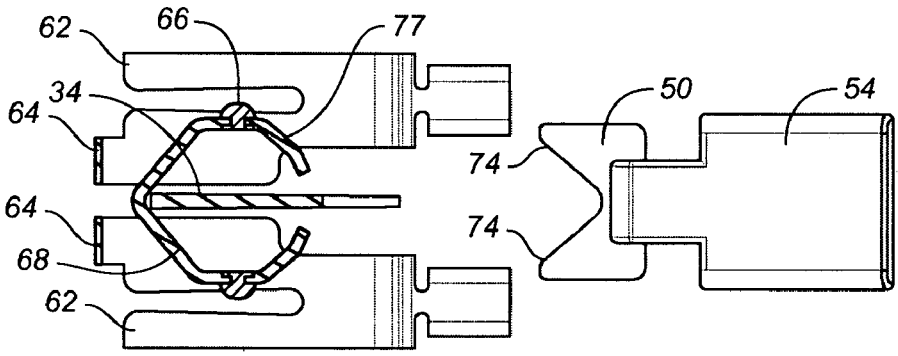
FIG. 5A is top view of a pair of receptacles, a locking member and a release member of the release mechanism of the embodiment of FIG. 1 with the receptacle housing cover removed to more clearly show the position of the locking tabs when the locking member are in the locked position.
Figure 5B:
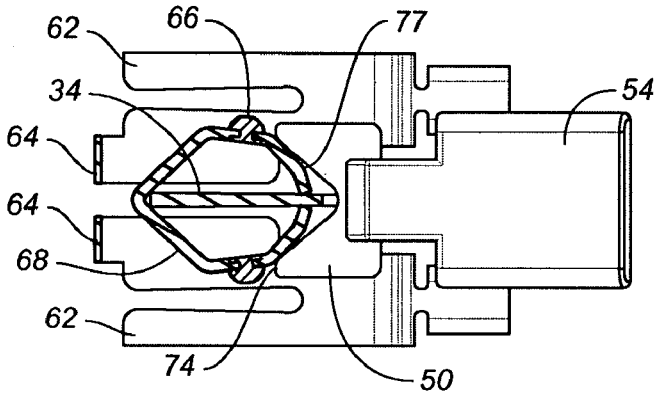
FIG. 5B is top view of a pair of receptacles, a locking member and a release member of the release mechanism of the embodiment of FIG. 1 with the receptacle housing cover removed to more clearly show the position of the locking tabs when the locking member is in the unlocked position.

FIGS. 5A and 5B show the critical automatic locking function of the present invention using the locking tabs 66 that are molded into the inner surfaces of the locking members 68 mounted between outer arms 62 of receptacles 38. The size of tab 66 is designed to easily fit within apertures 17 of prongs 16 when outlet 10 is in the locked position as described in detail below. To assure that the locking member has sufficient force for the locking function, the locking member used in the present invention is preferably plastic and the tabs are metal. Preferably the locking member is molded from a thermoplastic having sufficient resiliency to be able to flex from the locked to the unlocked position and to return the locking tabs to their locked state. This feature allows for the automatic locking of outlet 10 to plug 18 when a user easily slides prongs 16 of plug 18 over tabs 66 as tabs 66 are positioned into apertures 17.

The locking tabs 66 can be implemented several different ways. For example, a small metal ball bearing or a BB can be embedded into the molten thermoplastic during the molding process of the locking member as shown in FIGS. 5A and 5B. Alternatively, the locking member 68 may stamped from a thin piece of sheet metal having pressed or dimpled locking tabs therein. The entire surface of the metal locking member is then over-molded with the thermoplastic except for the locking tabs. The locking member 68 is sized to fit between the pair of receptacles 28 as shown in FIGS. 5A and 5B. The locking tab has the same diameter as the aperture of a standard plug.

Release button 54 is mounted through orifice 69 in end 70 of housing cover 30 (shown in FIG. 4). Outlet 10 is in the unlocked position after a user pushes cover 58. This causes button 54 and the outwardly angled ends 74 of release member 50 to slide along the inwardly angled ends 77 of locking members 68 until tab 66 is completely moved out of receptacle 38 as shown in FIG. 5B.

Figure 6A:
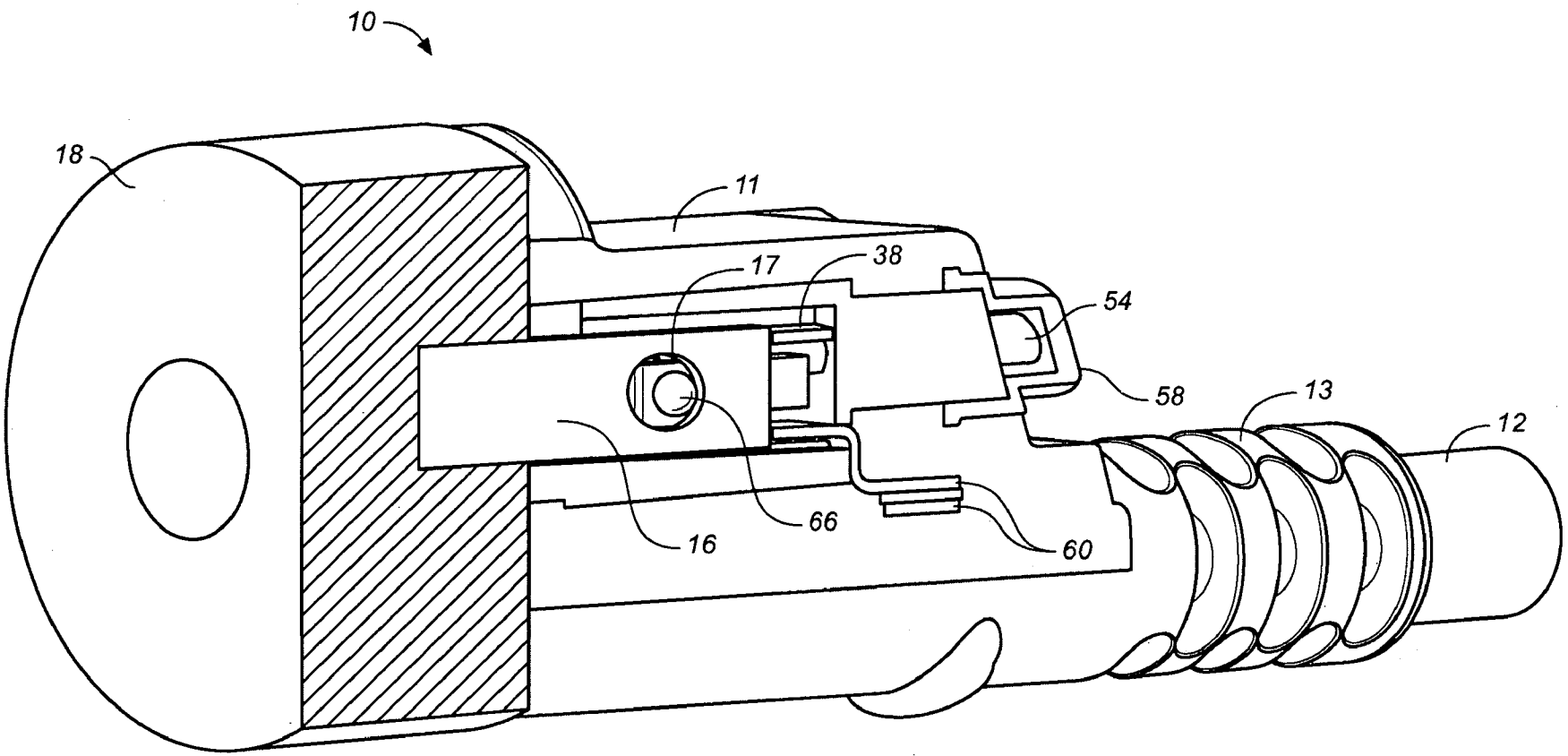
FIG. 6A is an upper right frontal perspective view, partially in section to show the locked position of the locking tab within the aperture of the standard grounded male electrical plug of the outlet of the embodiment of FIG. 1.
Figure 6B:
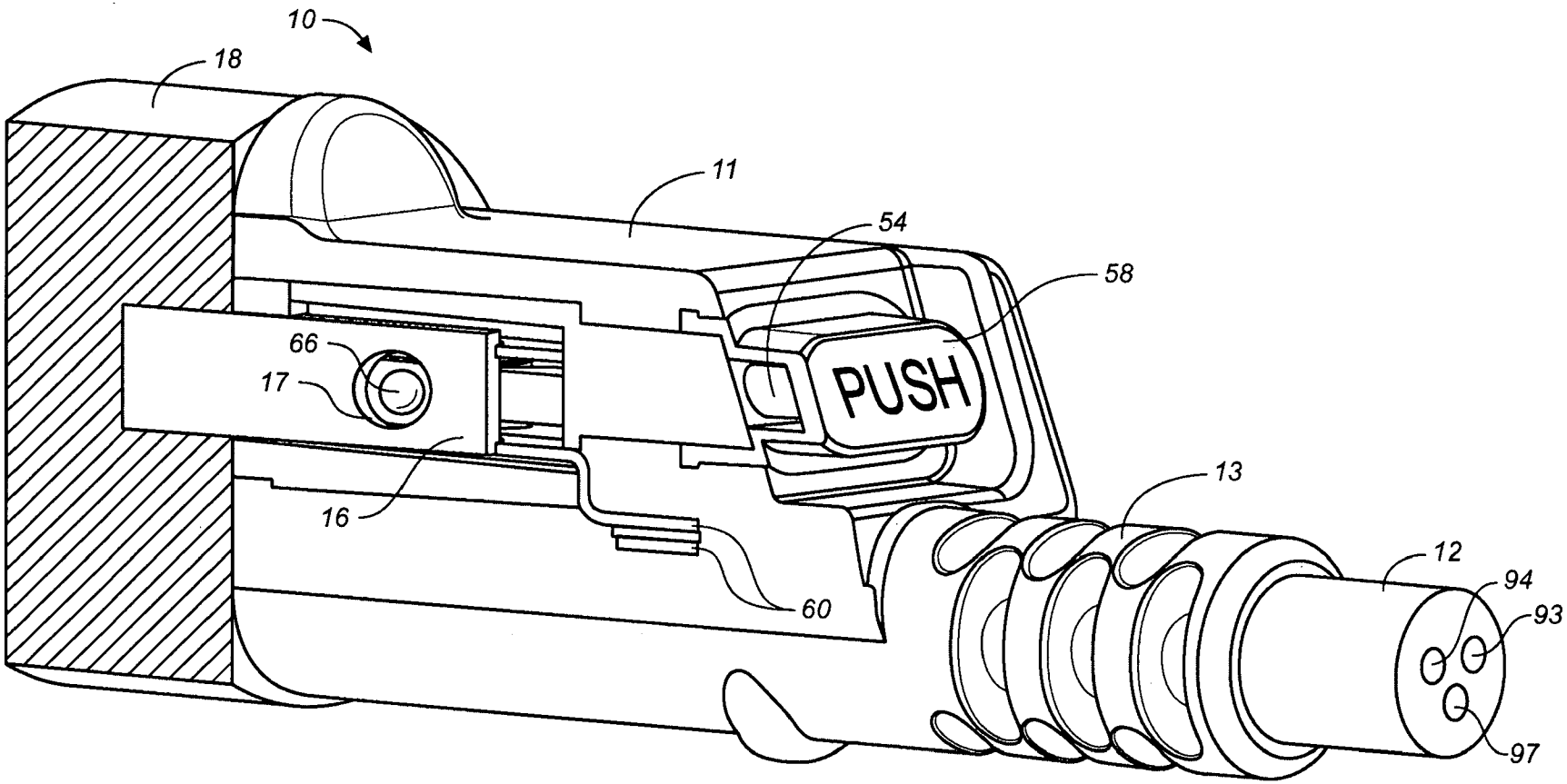
FIG. 6B is an upper right rear perspective view, partially in section to show the locked position of the locking tab within the aperture of the standard grounded male electrical plug of the outlet of the embodiment of FIG. 1.

FIGS. 6A and 6B show the perspective frontal and rear views of outlet 10 in its fully locked position, i.e., after electric plug 18 is connected to outlet 10 and locking tabs 66 are lodged within the respective apertures 17 of prongs 16.

Figure 7A:
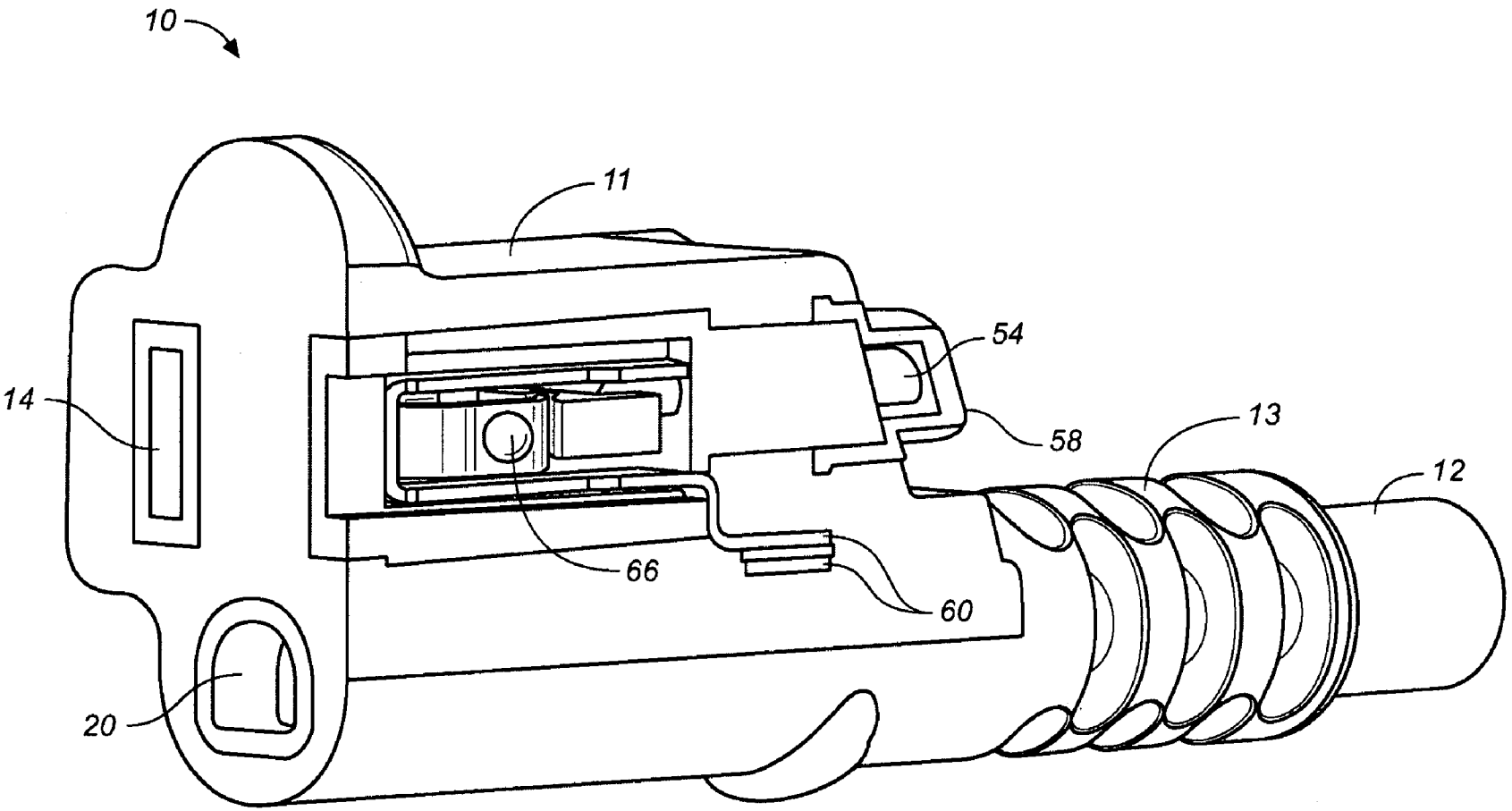
FIG. 7A is an upper right frontal perspective view, partially in section to show the locked position of the locking tab of the outlet of the embodiment of FIG. 1.
Figure 7B:
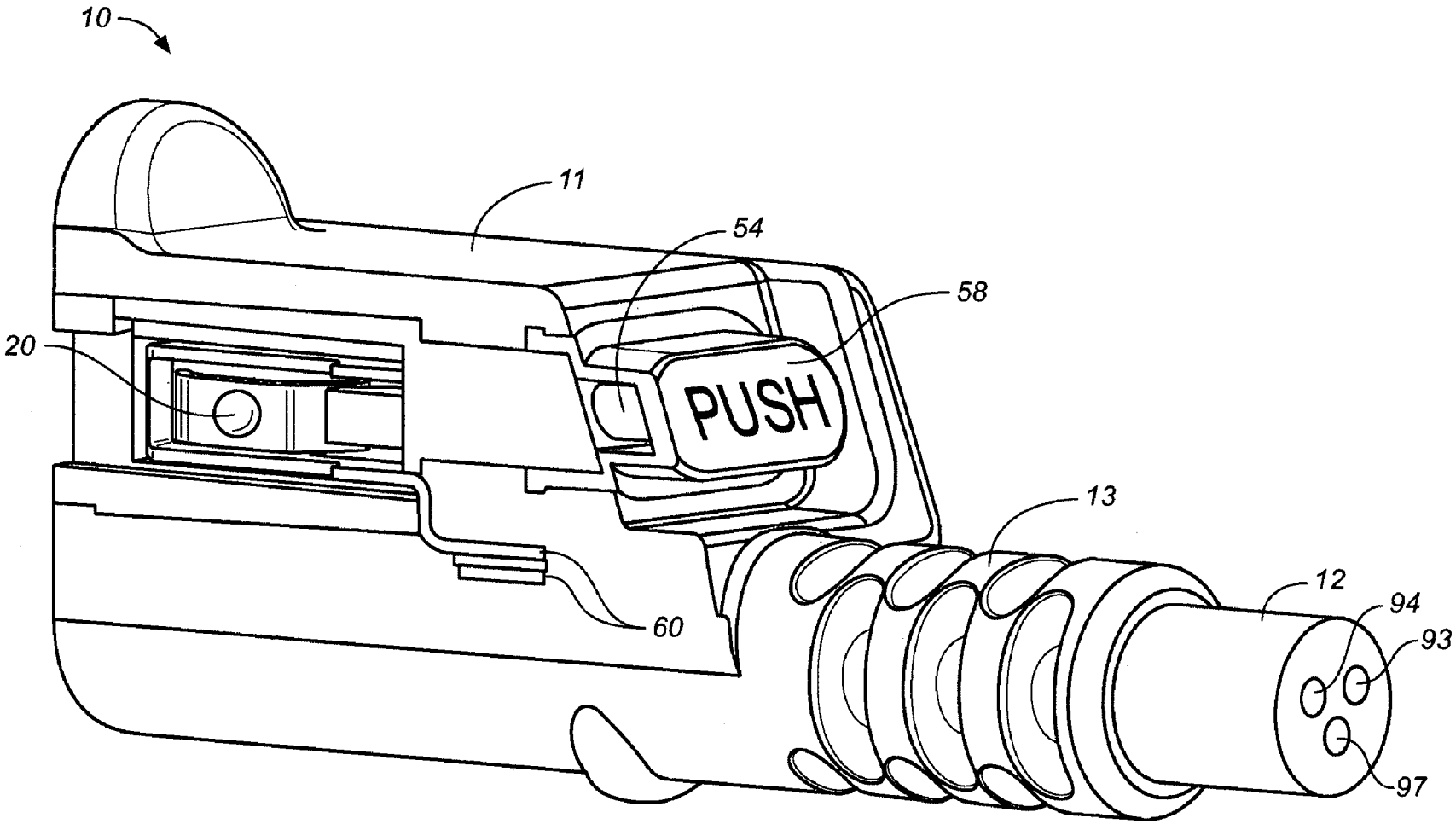
FIG. 7B is an lower right rear perspective view, partially in section to show the locked position of the locking tab of the outlet of the embodiment of FIG. 1.

FIGS. 7A and 7B show the respective frontal and rear views of outlet 10 in the unlocked position after electric plug 18 is released from outlet 10 and locking tabs 66 are dislodged from the respective apertures 17 of prongs 16 as the result of the user pushing in on cover 58 on button 54.

Outlet 10 is considered an automatic locking electrical outlet because outlet 10 is in the locked position as soon as the user inserts plug 18 entirely into outlet 10 so that end 76 of plug 18 is flush with outer surface 78 of outlet 10. As the user inserts plug 18 into outlet 10, prongs 16 slide within slots 14 and into the respective receptacles 38. When prongs 16 come into contact with locking tabs 66, they urge against the tabs until locking tabs 66 come into alignment with apertures 17. When plug end 76 is flush with outer surface 78, locking tabs 66 are positioned within apertures 17 and are fully lodged within apertures 17 to prevent removal of outlet 10 as shown in FIGS. 6A and 6B.

Plug 18 is removed from outlet 10 when the user presses cover 58 which in turn urges release button 54 of release mechanism 48 forward and causes release member ends 74 of release member 50 to press against inwardly angled ends 77 of locking members 68 of receptacle 38. Preferably, release member outwardly angled ends 74 are tapered to match the slope of inwardly angled ends 77. As outwardly angled ends 74 are urged against inwardly angled ends 77, outlet 10 transitions from the locked position to the unlocked position. Specifically, respective locking tabs 66 move inward toward the longitudinal axis 84 of outlet 10 and away from and completely out of apertures 17 to enable the user to remove plug 18 from outlet 10. In the unlocked position, locking tabs 66 are in their maximum inward position with respect to longitudinal axis 84 of outlet 10 (shown in FIG. 8).

Figure 8:
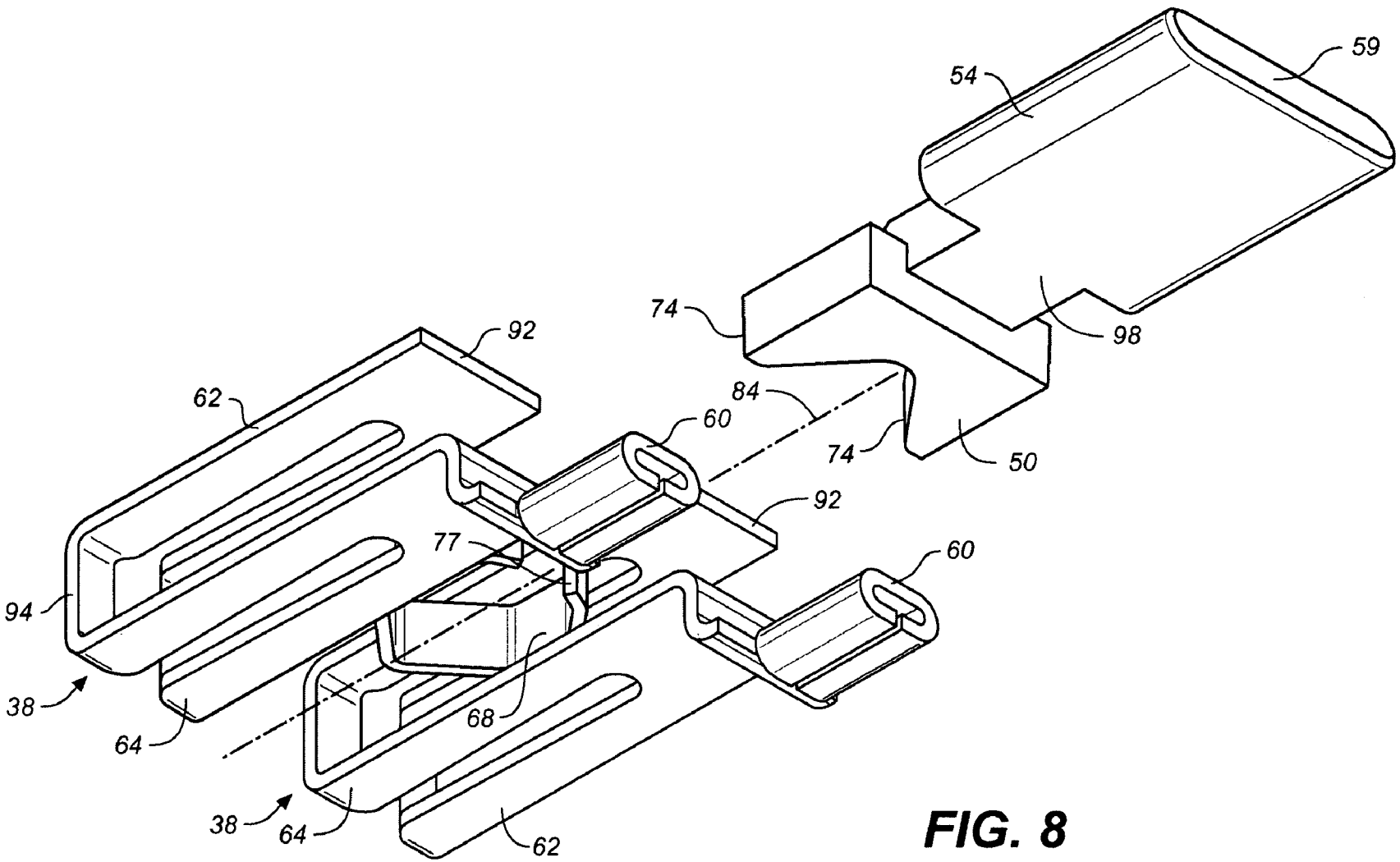
FIG. 8 is an exploded lower right rear perspective view of a pair of receptacles a locking member and a release member of the release mechanism of the embodiment of FIG. 1.

FIG. 8 shows a rear view of a pair of receptacles 38 a locking member 68 with release member 50 in the locked position. In the locked position, locking tabs 66 are in their maximum outward position with respect to horizontal axis 84. This is achieved when release button 54 has been fully pressed forward toward slots 14 so that shoulders 88 (shown in FIG. 5) of release button 54 are adjacent and in close proximity to, but not in contact with, inner ends 92 of receptacles 38.

Preferably receptacles 38 are made of a suitable electrical conducting material, e.g., brass. Each locking member 68 is preferably manufactured by being stamped out of the same piece of metal as locking tabs 66 and has a thickness in the range of about 0.015 to about 0.05 inch, and still more preferably a thickness of about 0.025 inch. Locking member 68 is then coated with a thin layer of thermoplastic as described above to prevent the locking member from making electrical contact with receptacles 38. Each of the receptacles 38 is a unitary U-shaped piece having a flange 60 on the lower side of receptacles 38 between outer arm 62 and inner arm 64 adjacent inner end 92. The outer end 94 of receptacles 38 is mounted adjacent slot 14. Outer arm 62 forms the outer loop and inner arm 64 forms the inner loop of U-shaped receptacles 38 that in turn forms the receptacle for one of apertured prongs 16.

Release button 54 of release mechanism 48 is joined to release member 50 by tongue 98 (shown in FIG. 5) to provide a slight offset toward the top of outlet 10. This offset and the fact that release button 54 has a width greater than tongue 98 allows for shoulders 88 to be pushed into close proximity to inner ends 92 when outlet 10 is in the unlocked position as discussed above. Release mechanism 48 is of unitary construction and made of a non-conducting material.

Figure 9:
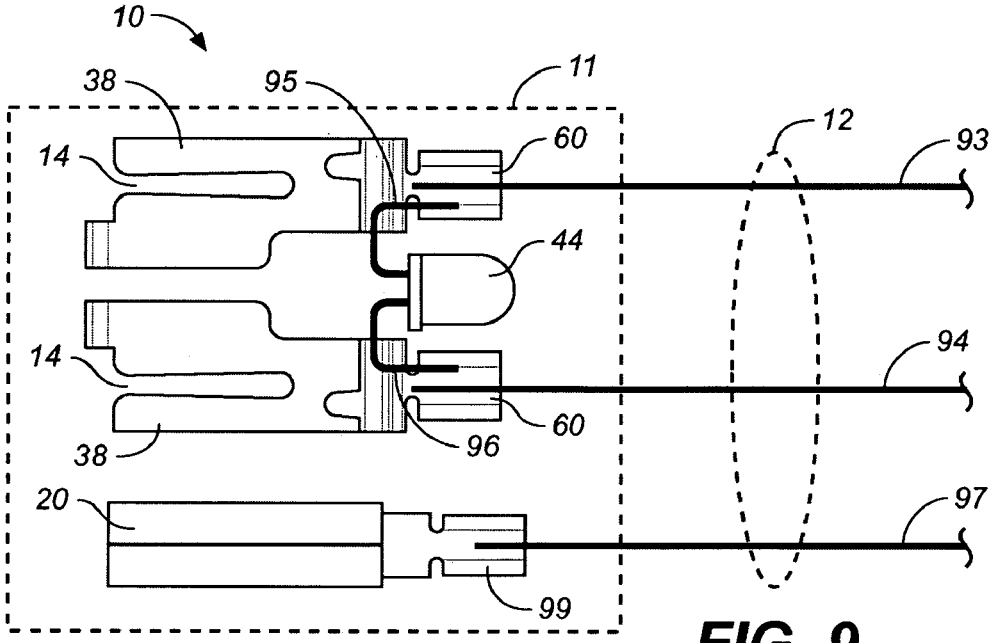
FIG. 9 is a bottom view of a pair of receptacles, flanges, an LED and a ground slot showing a connection with the respective positive line, negative line and ground line shown in FIGS. 6B and 7B.

FIG. 9 shows the electrical connection for outlet 10 in which the negative lead line 93 and positive lead line 94 are crimped into flanges 60 of receptacles 38. In one embodiment of the outlet of the present invention, LED 44 is included. In this embodiment, negative lead line 95 and positive lead line 96 from receptacles 38 are directly connected to LED 44 as shown so that LED 44 is always lit when electrical current is flowing even when outlet 10 is in an unlocked position. Ground wire 97 is shown connected to ground lug 99.

Figure 14:
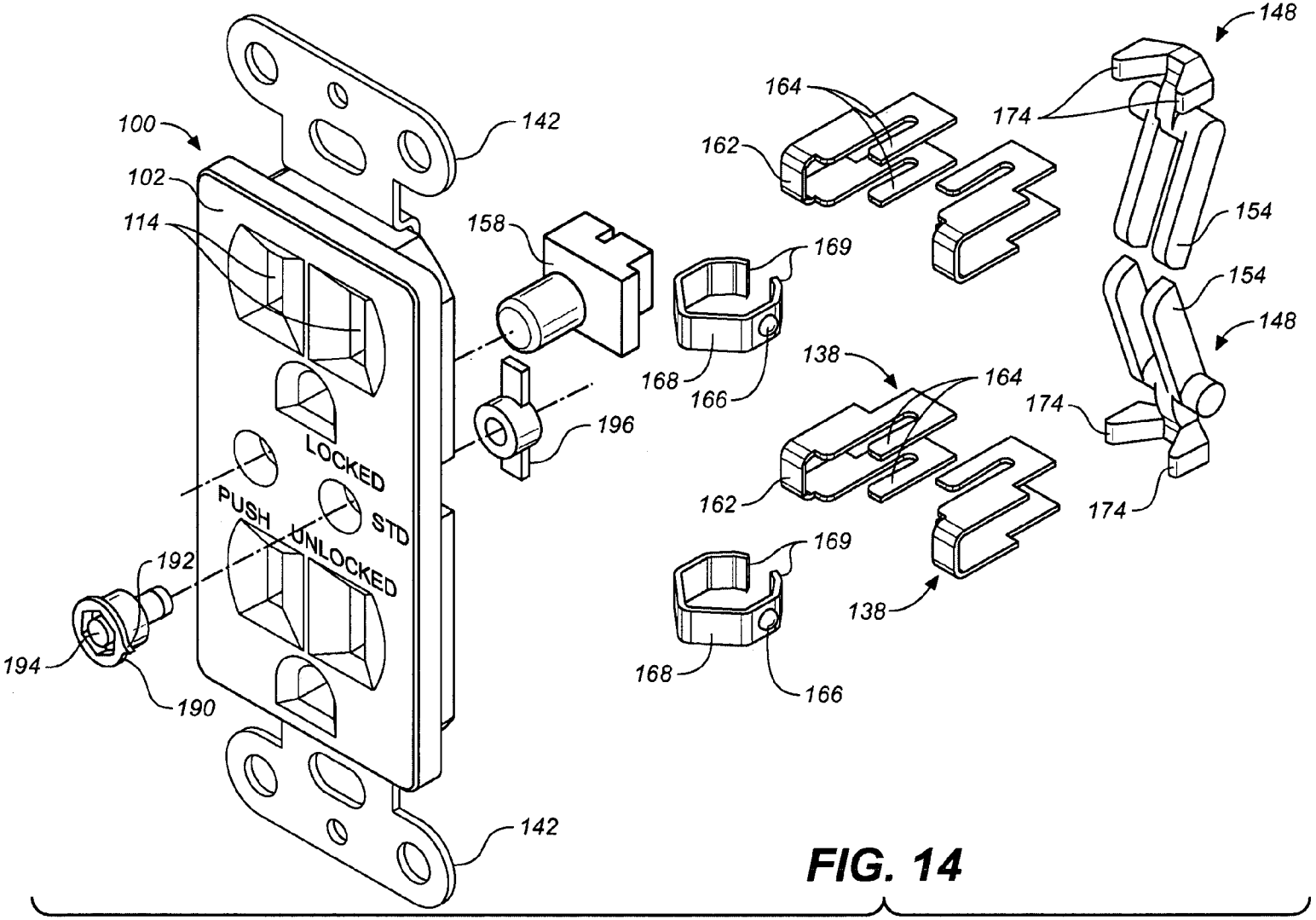
FIG. 14 is an exploded upper right frontal perspective view of the female locking wall receptacle of the embodiment shown in FIG. 10.
Figure 15A:
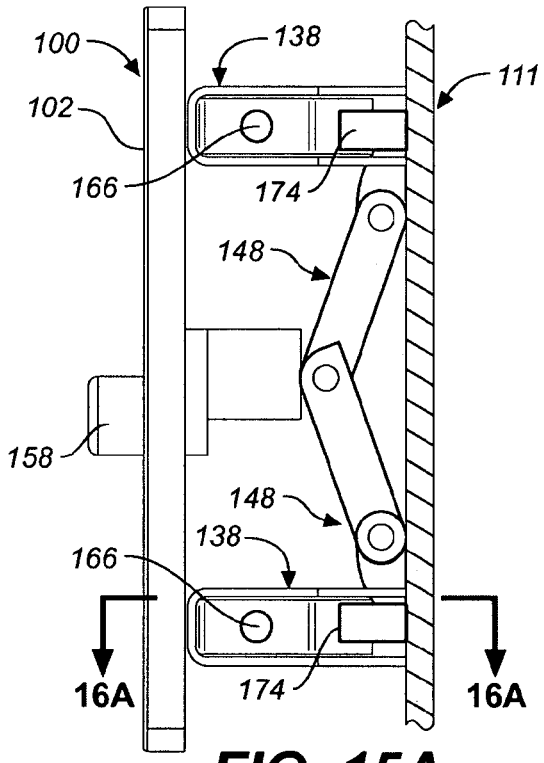
FIG. 15A is a right side plan view of the assembled internals of the female locking wall receptacle of the embodiment shown in FIG. 10 within a standard wall outlet box in which the receptacle is in a standard position.
Figure 15B:
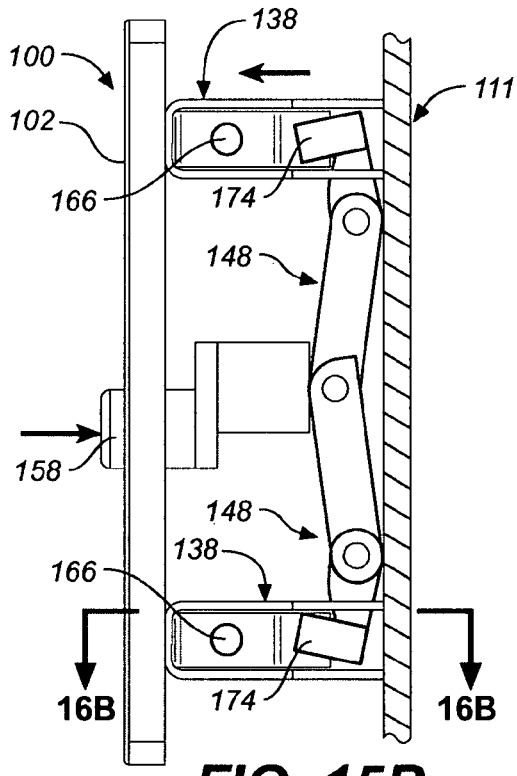
FIG. 15B is a right side plan view of the assembled internals of the female locking wall receptacle of the embodiment shown in FIG. 10 within a standard wall outlet box in which the receptacle is in an unlocked position.
Figure 16A:
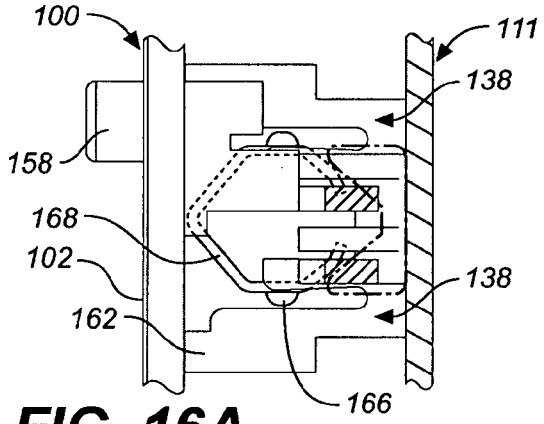
FIG. 16A is a top sectional view of the assembled internals of the female locking wall receptacle shown in FIG. 15A taken along line 16A-16A.
Figure 16B:
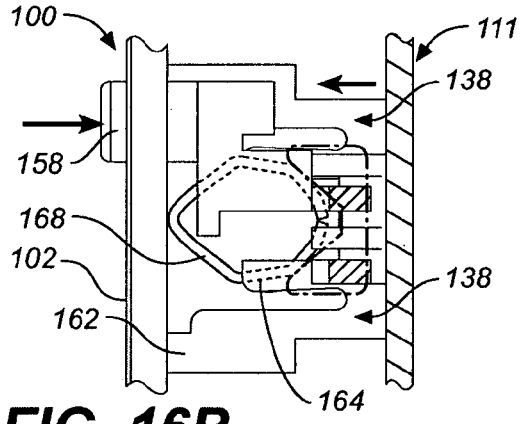
FIG. 16B is a top sectional view of the assembled internals of the female locking wall receptacle shown in FIG. 15B taken along line 16B-16B.
Figure 17A:
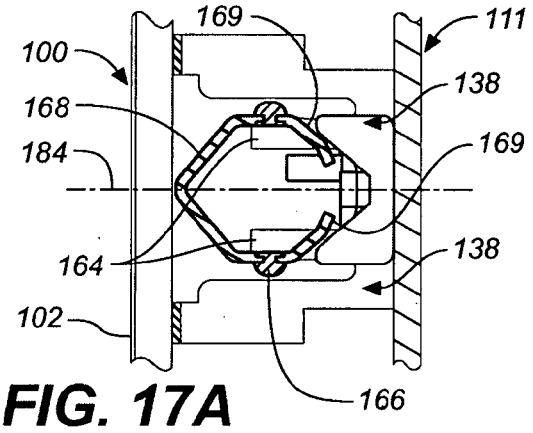
FIG. 17A is a top sectional view of the assembled internals of the female locking wall receptacle shown in FIG. 15A taken along line 17A-17A.
Figure 17B:
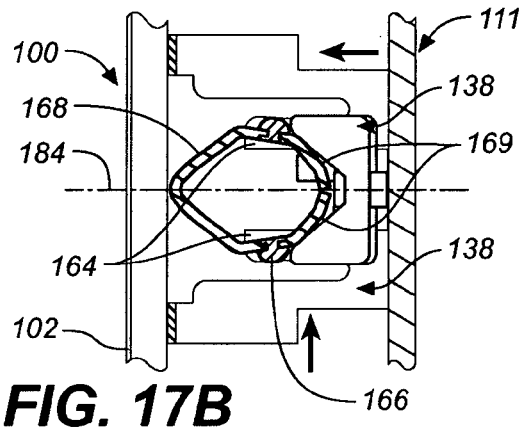
FIG. 17B is a top sectional view of the assembled internals of the female locking wall receptacle shown in FIG. 15B taken along line 17B-17B.

FIGS. 10-17B show various views of another embodiment of the present invention in which a female wall receptacle 100 is designed so that outlet body 102 fits within the opening of a standard outlet plate 110 and the internals of receptacle 100 can be mounted within a standard outlet box 111, the back of which is shown in FIGS. 15A 17B.

Figure 10:
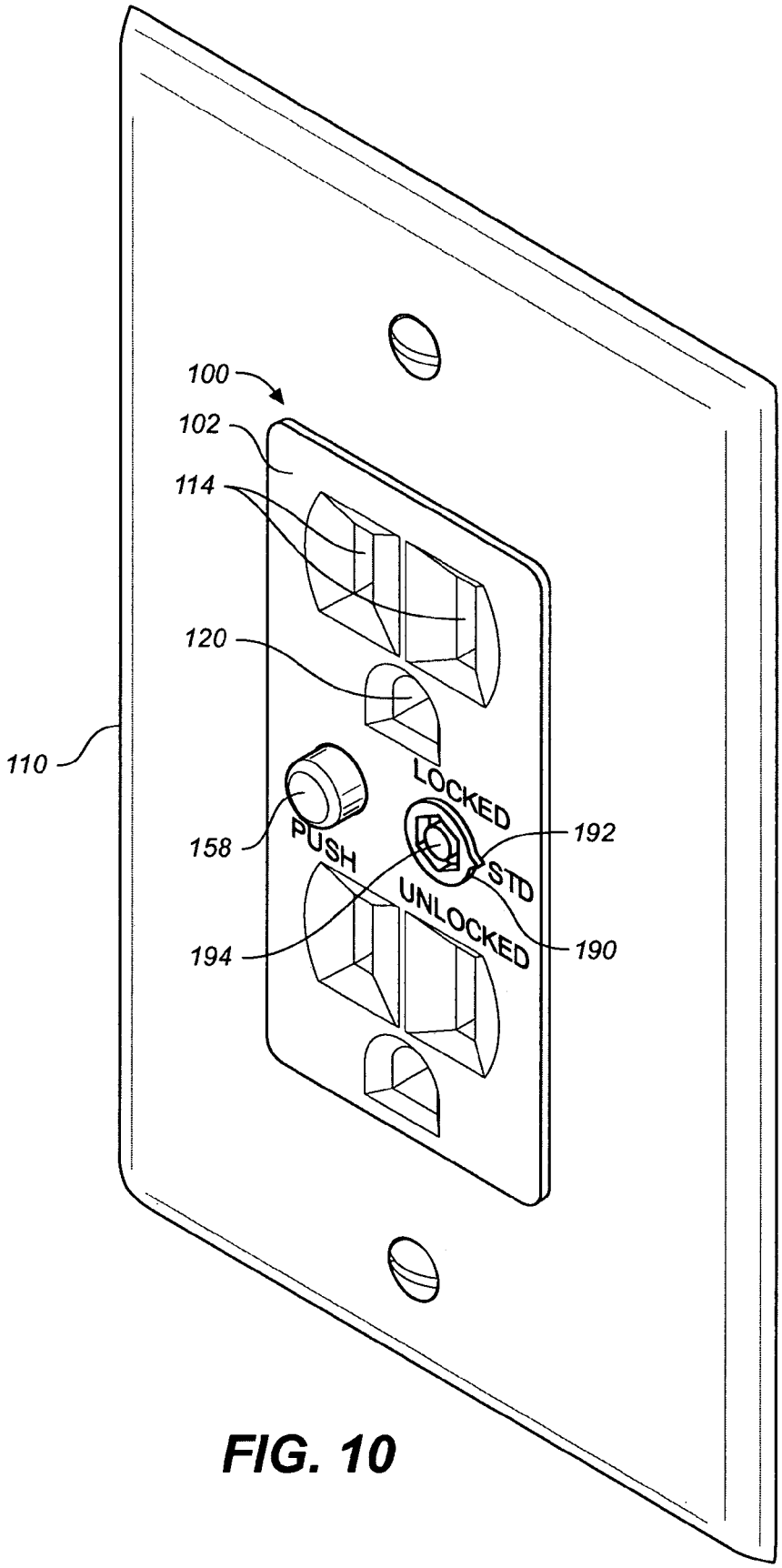
FIG. 10 is a upper right frontal perspective view of an outlet body within an outlet plate of a female locking wall receptacle of another embodiment of the present invention for mounting to a standard outlet box.

FIG. 14 shows the exploded view of the internals of female locking wall receptacle 100 that include outlet body 102, slots 114 for accepting the negative and positive prongs 16 of plug 18, ground slot 120, a pair of receptacles 138 for each of the slots 114, a locking member 168, mounting tabs 140 on outlet body 102 for attaching outlet body 102 with the screws shown on FIG. 10 to standard outlet plate 110, release mechanism 148 having release arm 154, and release button 158.

Outlet 100 has the same automatic locking feature as described above in connection with outlet 10. Outlet 100 is automatically in the locked position as soon as the user inserts plug 18 entirely into outlet 100 so that end 76 of plug 18 is flush with outer surface of outlet 100. As the user inserts plug 18 into outlet 100, prongs 16 slide within slots 114 and into the respective receptacles 138 having outer arm 162 and inner arm 164. When prongs 16 come into contact with locking tabs 166, they urge against the tabs until locking tabs 166 come into alignment with apertures 17. When plug end 76 is flush with outer surface of outlet body 102, locking tabs 166 are positioned within apertures 17 and are fully lodged within apertures 17 to prevent removal of outlet 100. Plug 18 is removed from outlet 100 when the user presses button 158 which in turn urges release arm 154 of release mechanism 148 forward and causes release member sidewall 174 of release mechanism 148 to press against outwardly angled ends 168 of the locking members 169 of receptacle 138. Release member outwardly angled sidewalls 174 are sloped to match the slope of outwardly angled ends 168 of the locking members 169 in the same manner as angled ends 74 are tapered to match the slope of inwardly angled ends 77 in outlet 10. In the same manner as in outlet 10 as inwardly angled sidewalls 174 of receptacle 100 are urged against outwardly angled ends 168, outlet 100 transitions from the locked position to the unlocked position. Specifically, respective locking tabs 166 move outward toward the horizontal axis 184 of outlet 100 and away from and completely out of apertures 17 to enable the user to remove plug 18 from outlet 100. In the unlocked position, locking tabs 166 are in their maximum outward position with respect to horizontal axis 184 of outlet 100 (shown in FIG. 17B).

Electrical connection of receptacle 100 can be made to conduit fed to the standard wall outlet box 111 by means well known to those skilled in the art. For example, brass and silver screws can be tightened to orifices (not shown) in the inner ends of receptacles 138 and the negative and positive lines are connected to the respective screws. In a similar manner, a grounding screw can be connected to the bare wire of the conduit, which is connected to a grounded receptacle. Alternatively, receptacles 138 can include flanges 60 for receiving the respective positive and negative lead lines and a ground receptacle 99 for receiving the bare ground wire that is described in the foregoing description of outlet 10 with reference to FIG. 9.

FIGS. 11A-11C and 12A-12C show the function of locking cylinder 190 that permits outlet 100 to have three locking options after a user rotates pointer 192 on the outer end of cylinder 190 and extending from the outer surface of outlet body 102 to one of three positions, i.e., standard, locked and unlocked. Locking cylinder 190 is rotated after a user inserts a proprietary key or other similar device (not shown) into pointer 192. The rotation of locking cylinder 190 causes a rotation of button stop 196 that is mounted over the inner end of cylinder 190.

The standard position of receptacle 100 is shown in FIGS. 10, 11A, 12A, 13 and 14. In the standard position, a user rotates cylinder 190 so that pointer 192 points to "STD" on outlet body 102 causing button stop 196 to rotate to a vertical position with respect to horizontal axis 184. Therefore, when a user inserts plug 18 into outlet 100, locking tabs 166 will automatically lock into the apertures 17 of plug 18 and when a user presses button 158 arms 154 are urged to pivot release mechanism 148 and surface 174 to urge locking member 168 away from apertures 17 and disengaging tabs 166 from aperture 17 allowing the user to remove plug 18 from outlet 100 as described in great detail in the foregoing description.

Figure 11A:
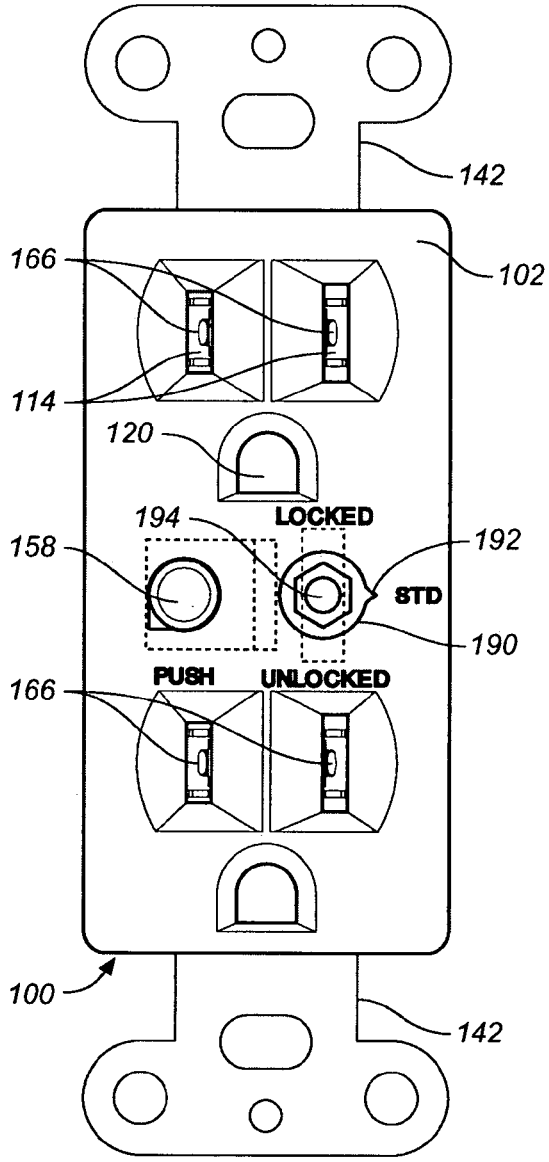
FIG. 11A is a front elevational view of the outlet body of the female locking wall receptacle of the embodiment shown in FIG. 10 in which the receptacle is in a standard position.
Figure 11B:
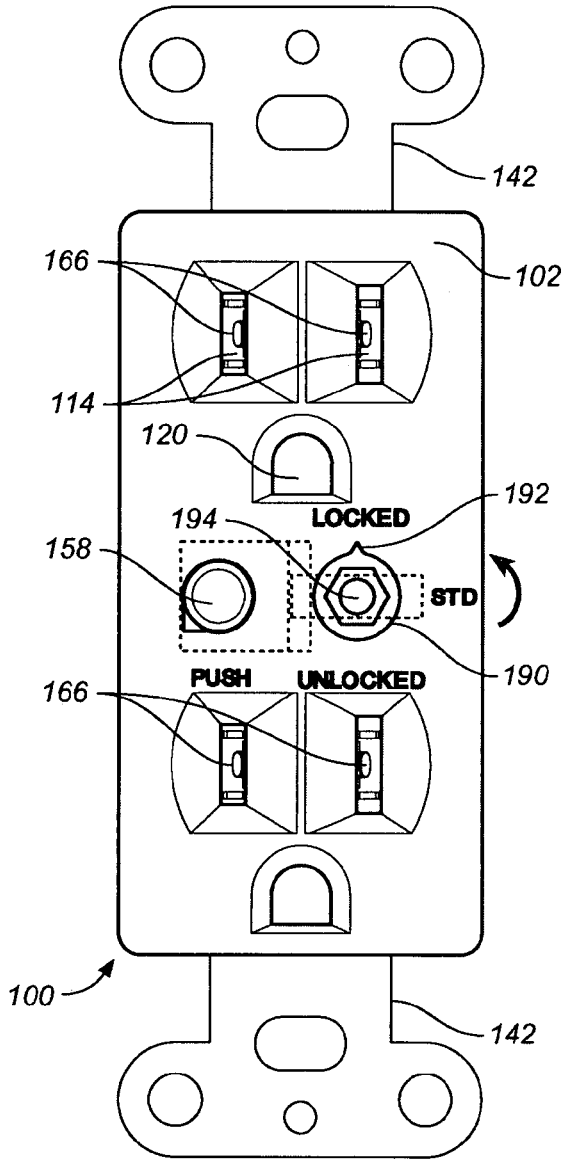
FIG. 11B is a front elevational view of the outlet body of the female locking wall receptacle of the embodiment shown in FIG. 10 in which the receptacle is in a locked position.
Figure 12A:
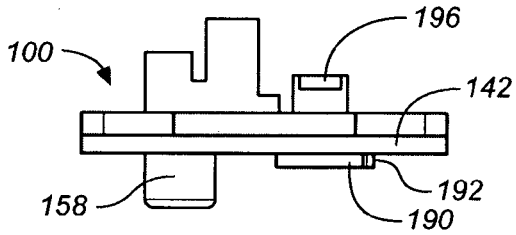
FIG. 12A is a top plan view of the outlet body of the female locking wall receptacle of the embodiment shown in FIG. 10 in which the receptacle is in a standard position.
Figure 12B:
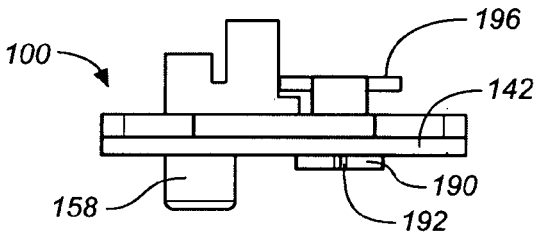
FIG. 12B is a top plan view of the outlet body of the female locking wall receptacle of the embodiment shown in FIG. 10 in which the receptacle is in a locked position.

The locked position of receptacle 100 is shown in FIGS. 11B and 12B. In the locked position, a user rotates cylinder 190 so that pointer 192 points to "LOCKED" on outlet body 102 causing button stop 196 to rotate counterclockwise to a first horizontal position. In this position, the notched inner end of plug 158 is lodged between the inner surface of outlet body 102 and button stop 196 and prevents a user from pressing button 158 inward. This permits a user to insert plug 18 in a conventional manner and to lock plug 18 in place so that only a user having the proprietary key will be able to unlocked receptacle 100. This is useful in, e.g., medical situations, to allow only authorized personnel having the key to turn off critical equipment.

Figure 11C:
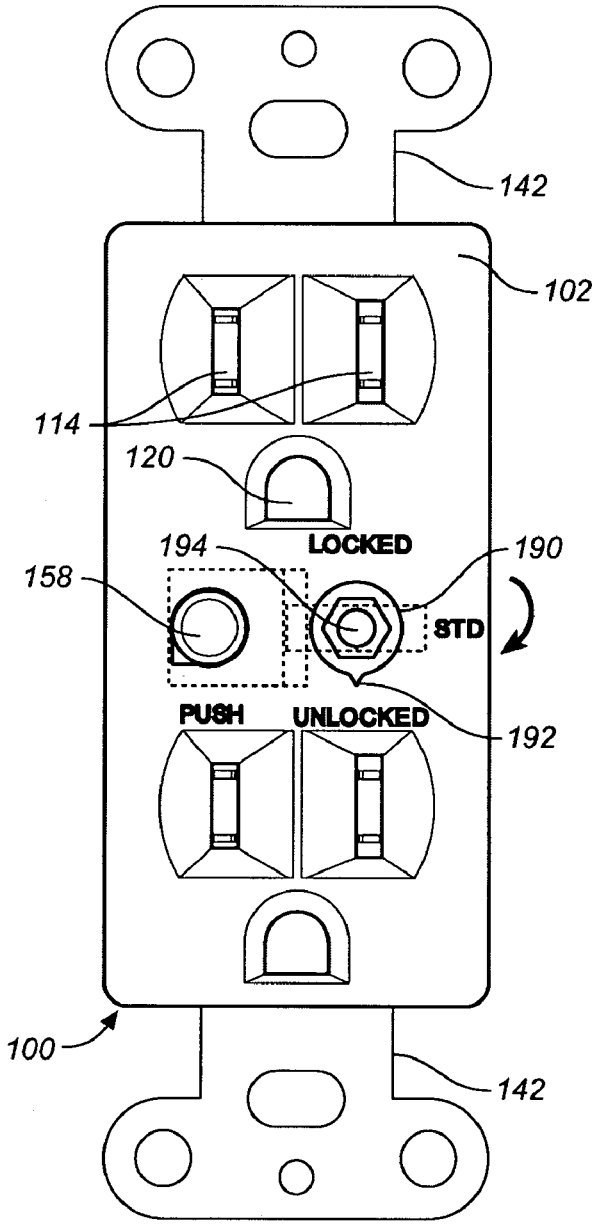
FIG. 11C is a front elevational view of the outlet body of the female locking wall receptacle of the embodiment shown in FIG. 10 in which the receptacle is in an unlocked position.
Figure 12C:
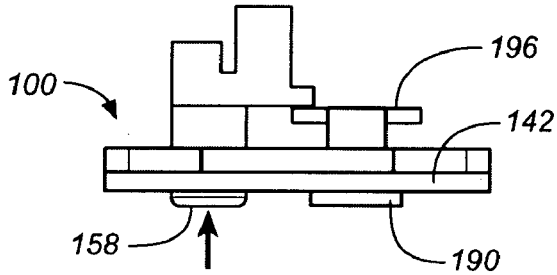
FIG. 12C is a top plan view of the outlet body of the female locking wall receptacle of the embodiment shown in FIG. 10 in which the receptacle is in an unlocked position.
Figure 13:
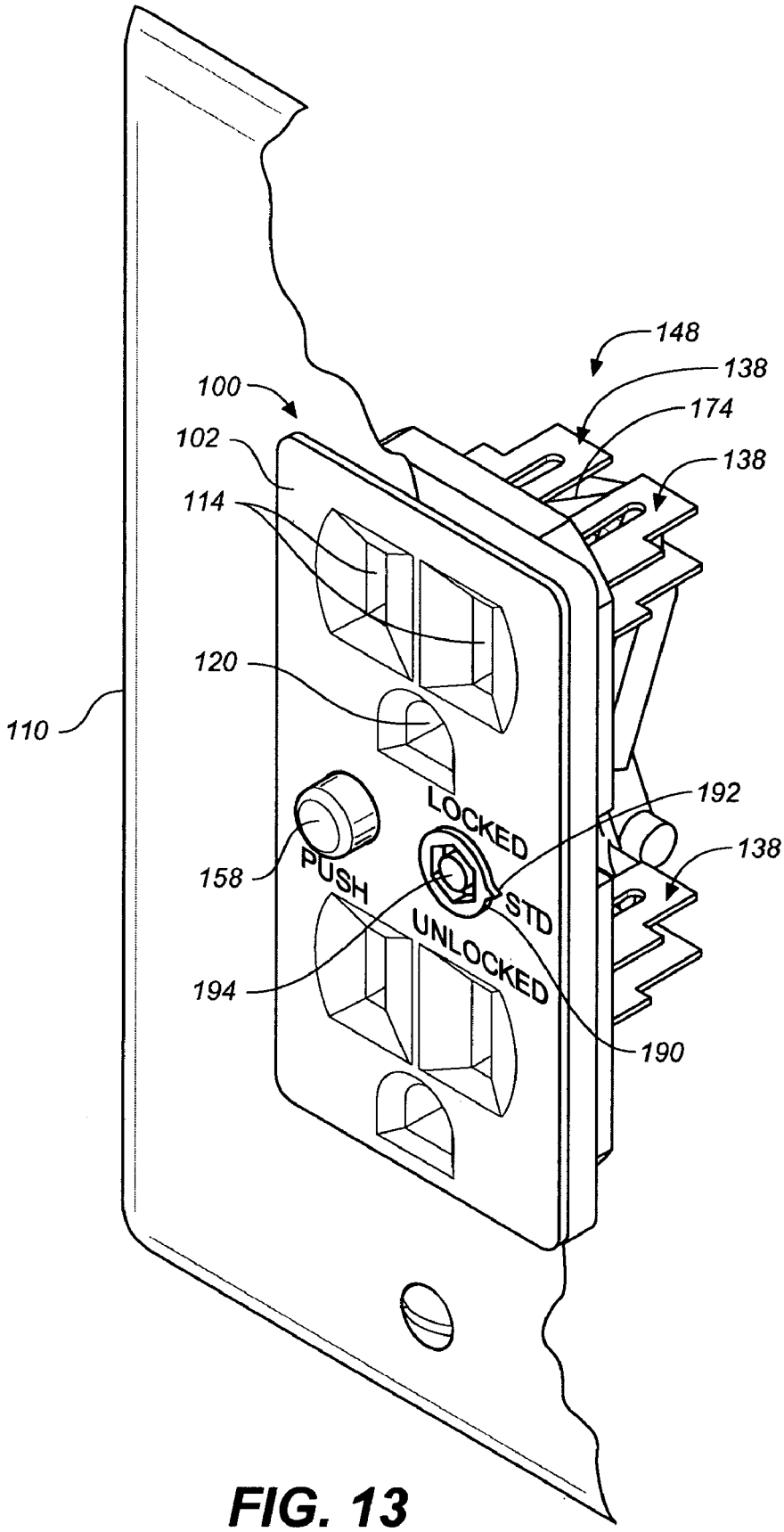
FIG. 13 is an upper right frontal perspective view of the female locking wall receptacle of the embodiment shown in FIG. 10, shown partially cutaway to show its internals.

The unlocked position of receptacle 100 is shown in FIGS. 11C and 1C. In the unlocked position, a user rotates cylinder 190 so that pointer 192 points to "UNLOCKED" on outlet body 102 causing button stop 196 to rotate clockwise to a second horizontal position. In the unlocked position, a user has pressed button 158 so that the notched inner end of plug 158 is pushed inward past button stop 196 before rotating cylinder 190 in the clockwise direction. Button stop 196 is urged in front of and against the notched inner end of plug 158 to prevent plug 18 from being locked into receptacle 100. This permits a user to insert and to remove plug 18 in a conventional manner without the automatic locking feature of the present invention.

Without departing from the spirit and scope of this invention, one of ordinary skill in the art can make various changes and modifications to the device of the present invention to adapt it to various usages and conditions. For example, while the female locking outlets are normally orientated along a generally longitudinal axis and the wall receptacle along a horizontal axis with respect to the locking tabs, modifications can be made to this orientation without adversely affecting the effectiveness of the locking function. As such, these changes and modifications are properly, equitably, and intended to be, within the full range of equivalents of the following claims.

What is claimed is:

1. A female locking electrical outlet comprising:

an outlet body having at least one pair of slots for apertured prongs of a male electrical plug;

a pair of receptacles for each of the at least one pair of slots respectively mounted within said outlet body and each receptacle having flanges for receiving electrical leads, and an outer arm and inner arm for making electrical contact with one of the apertured prongs of the electrical plug;

a locking member having inner ends inwardly angled toward a longitudinal axis of the outlet and locking tabs for each of said receptacles, said locking member positioned between the outer arms of said receptacles so that said locking tabs are positional within apertures in the prongs to place said outlet in a locked position when an the electrical plug is connected to the outlet; and at least one unlocking mechanism within said outlet body having a release button and a release member for engaging said locking member and to transition said locking member from the locked position to an unlocked position, said release member having tapered ends joined to said release button that a user urges toward the pair of slots during the transition from the locked position to the unlocked position causing the tapered ends of said release member to press inward on the inner ends of said locking member and to cause said locking tabs to move toward the longitudinal axis of the outlet.

2. The electrical outlet of claim 1, wherein the outlet body has a slot for a grounded prong of the electric plug.

3. The electrical outlet of claim 1, wherein said locking tabs have sufficient strength to prevent unwanted unlocking of the outlet.

4. The electrical outlet of claim 1, wherein said outlet body has multiple pairs of slots for multiple male electrical plugs and has, for each pair of slots, said pair of receptacles, said locking member, and said unlocking mechanism.

5. The electrical outlet of claim 1, wherein said locking tabs are molded into said locking member.

6. The electrical outlet of claim 1, wherein said inner end that is depressed toward the longitudinal axis as the user inserts a prong of the plug into the receptacle until the tab is positioned the aperture in the locking position.

7. The electrical outlet of claim 1, wherein said release button is joined to release member by a tongue to provide a slight offset away from the longitudinal axis and said release button has a width greater than the tongue to provide a pair of shoulders that come into close proximity with the inner ends of locking member when said outlet is in the unlocked position.

8. The electrical outlet of claim 1, wherein said receptacles are operably connected to negative and positive lines, and a light emitting diode is also operably connected to the negative and positive lines so that when the light is on electrical current is flowing to said outlet.

9. A female locking electrical outlet comprising:

an outlet body having at least one pair of slots for apertured prongs of a male electrical plug and at least one central cavity;

a receptacle housing body within the at least one central cavity having a longitudinal axis therethrough;

a pair of receptacles for each of the at least one pair of slots respectively mounted within said receptacle housing body and each receptacle having an outer arm and inner arm for making electrical contact with one of the apertured prongs of the electrical plug and flanges for receiving electrical leads;

a locking member having inner ends and locking tabs for each of said receptacles, said locking member positioned between the outer arms of said receptacles so that said locking tabs are positional within apertures in the prongs to place said outlet in a locked position when an electrical plug is connected to the outlet, each inner end of which is angled inwardly toward a longitudinal axis of the outlet and depressed toward the longitudinal axis as a user inserts a prong of the plug into the receptacle until each of said locking tabs is positioned into the aperture in the locking position; and at least one unlocking mechanism having a release button and a release member for engaging each of the inner ends of said locking member and to transition said locking member from the locked position to an unlocked position, said release member having ends that are tapered outwardly from the longitudinal axis and joined to said release button that the user urges forward during the transition from the locked position to the unlocked position causing the tapered ends of said release member to press inward on the tapered inner ends of said locking member and to cause said locking tabs to move toward a longitudinal axis.

10. A female locking electrical outlet comprising:

an outlet body having two pairs of slots within the body for apertured prongs of a male electrical plug, said outlet body is capable of being mounted in an opening of a standard outlet plate;

a pair of receptacles for each of the two pairs of slots respectively, said receptacles are capable of being mounted within a standard wall outlet box;

a locking member positioned between each of said pair of receptacles and having locking tabs for each of said receptacles that are positional within apertures in the prongs to place said outlet in a locked position when an electrical plug is connected to the outlet; and a pair of unlocking mechanisms within the wall outlet box, each of said pair of unlocking mechanisms having a release button and a release member for engaging each of said locking tabs and to transition said locking member from the locked position to an unlocked position, said a release member having tapered ends joined to said release button that a user urges forward toward the pair of slots during the transition from the locked position to the unlocked position causing the tapered ends of said release member to press inward on tapered ends of said locking member and to cause said locking tabs to move toward a horizontal axis of the outlet.

11. The electrical outlet of claim 10, wherein the outlet body has a slot for a grounded prong of the electric plug.

12. The electrical outlet of claim 10, wherein each of said receptacles has flanges for receiving electrical leads and outer arm and inner arm for making electrical contact with one of the apertured prongs of the electrical plug, and said locking member is positioned between the outer arms of each of the pair of receptacles.

13. The electrical outlet of claim 10, wherein each of said tapered inner ends of each of said locking members is angled inwardly toward the horizontal axis of the outlet and is depressed toward the horizontal axis as the user inserts a prong of the plug into the receptacle until the tab is positioned into the aperture in the locking position.

14. The electrical outlet of claim 10, wherein said locking tabs are molded into each of said locking members.

15. The electrical outlet of claim 14, wherein each of said locking tabs is a thermoplastic and each of said locking tabs is metal that is molded into the thermoplastic so that the exterior of the locking tab is coated in the thermoplastic.

16. The electrical outlet of claim 10, wherein a locking cylinder is mounted on said outlet body to allow the user to change the receptacle from the automatic locking function to locked and unlocked positions.

17. The electrical outlet of claim 16, wherein said locking cylinder has a button stop mounted to its inner end and is rotated in the locked position to cause the button stop to rotate to a first horizontal position to cause an inner portion of said release button to lodge between an inner surface of the outlet body and the button stop to prevent the user from pressing said release button.

18. The electrical outlet of claim 17, wherein said locking cylinder in the unlocked position is rotated to cause the button stop to rotate to a second horizontal position to cause an inner portion of the release button to lodge in front of and against the inner surface of the outlet body to allow the user to use the outlet in a conventional manner.

* * * * *